US010988997B2

(12) United States Patent
Santos

(10) Patent No.: US 10,988,997 B2
(45) Date of Patent: Apr. 27, 2021

(54) METHOD AND SYSTEM FOR SAFE PRESSURIZED MUD CAP DRILLING

(71) Applicant: SafeKick Americas LLC, Katy, TX (US)

(72) Inventor: Helio Mauricio Ribeiro dos Santos, Reading (GB)

(73) Assignee: SAFEKICK AMERICAS LLC, Katy, TX (US)

( * ) Notice: Subject to any disclaimer, the term of this patent is extended or adjusted under 35 U.S.C. 154(b) by 598 days.

(21) Appl. No.: 15/876,798

(22) Filed: Jan. 22, 2018

(65) Prior Publication Data

US 2019/0226290 A1 Jul. 25, 2019

(51) Int. Cl.

| | |
|---|---|
| ***E21B 21/08*** | (2006.01) |
| ***E21B 21/10*** | (2006.01) |
| *E21B 21/06* | (2006.01) |

(52) U.S. Cl.

CPC ..... *E21B 21/08* (2013.01); *E21B 21/10* (2013.01); *E21B 21/067* (2013.01)

(58) Field of Classification Search

CPC ..... E21B 21/08; E21B 21/10; E21B 21/067
See application file for complete search history.

(56) References Cited

U.S. PATENT DOCUMENTS

2011/0297388 A1* 12/2011 Stave ..... E21B 21/08 166/345
2014/0124265 A1* 5/2014 Al-Yami ..... G06N 7/005 175/24
2014/0202772 A1 7/2014 Kulkarni et al.
2016/0222751 A1* 8/2016 Bullock ..... E21B 3/02
2017/0226813 A1* 8/2017 Northam ..... E21B 21/106

(Continued)

FOREIGN PATENT DOCUMENTS

WO 2017115344 A3 7/2017

OTHER PUBLICATIONS

International search report of international search authority for PCT international application PCT/US2018/062404 dated Feb. 1, 2019.

(Continued)

*Primary Examiner* — Christopher J Sebesta
(74) *Attorney, Agent, or Firm* — Basil M. Angelo; Angelo IP

(57) ABSTRACT

A method of safe pressurized mud cap drilling includes determining a set point for a surface backpressure choke manifold, injecting sacrificial fluids into a drillstring disposed in a wellbore, injecting weighted mud into an annulus, and monitoring a surface backpressure. If the surface backpressure rises above the set point, closing one or more chokes of the surface backpressure choke manifold in a stepwise incremental manner to increase an injection rate of weighted mud into the annulus. If the surface backpressure falls below the set point, opening the one or more chokes of the surface backpressure choke manifold in a stepwise incremental manner to decrease the injection rate of weighted mud into the annulus. If the surface backpressure is substantially equal to the set point, maintaining a state of the one or more chokes of the surface backpressure choke manifold to maintain the injection rate of weighted muds into the annulus.

12 Claims, 6 Drawing Sheets

(56) References Cited

U.S. PATENT DOCUMENTS

| | | | | |
|---|---|---|---|---|
| 2018/0163489 | A1* | 6/2018 | Dillard | E21B 21/106 |
| 2019/0145202 | A1* | 5/2019 | Vavik | E21B 21/10 175/25 |

OTHER PUBLICATIONS

Written opinion of international search authority for PCT international application PCT/US2018/062404 dated Feb. 1, 2019.

Santos, Helio, Muir, Ken. Optimizing and Automating Pressurized Mud cap Drilling with the Micro-Flux Control Method. SPE 116492. SPE International. Prepared for presentation at SPE Asia Pacific Oil & Gas Conference and Exhibition, Perth, Australia, Oct. 20-22, 2008.

* cited by examiner

METHOD AND SYSTEM FOR SAFE PRESSURIZED MUD CAP DRILLING

BACKGROUND OF THE INVENTION

Managed pressure drilling is a drilling technique that seeks to maintain well control by managing wellbore pressure within a pressure gradient bounded by the pore pressure and the fracture pressure of the formation. The pore pressure refers to the pressure of the fluids inside the pores of a reservoir. If the pressure in the annulus falls below the pore pressure, formation fluids, liquid or gas, may flow into the wellbore and well control may be lost. The unintentional influx of unknown formation fluids into the wellbore is commonly referred to as a kick. Kicks are inherently dangerous due to the potential for blowouts caused by explosive gas. The fracture pressure refers to the pressure at which the formation hydraulically fractures or cracks. If the pressure in the annulus rises above the fracture pressure, expensive drilling fluids may be lost to the formation and well control may be lost.

Managed pressure drilling manages wellbore pressure through manipulation of one or more chokes of a surface backpressure choke manifold connected by one or more fluid flow lines that divert fluid return from an annular closing device that controllably seals the annulus around the drillstring. Each choke valve of the surface backpressure choke manifold is capable of a fully opened state where flow is unimpeded, a fully closed state where flow is stopped, and a number of partially opened/closed states where flow is restricted. The chokes are typically opened or closed in a stepwise incremental manner. Generally, if the pressure in the annulus falls below a lower threshold, one or more chokes may be closed to an extent to increase the annular pressure. Similarly, if the pressure in the annulus increases above an upper threshold, one or more chokes may be opened to an extent to decrease the annular pressure. In this way, one form of managed pressure drilling manages wellbore pressure within the pressure gradient by management of surface backpressure.

During conventional drilling operations, expensive drilling fluids, commonly referred to as mud, are pumped through the interior passage of the drillstring, out of the drill bit, and then return to the surface through the annulus. The drilling fluids cool and lubricate the drill bit, flush cuttings from the bottom of the hole, and counterbalance the formation pressure. The returning fluids are typically processed on the surface and the drilling fluids are separated and recycled for further use downhole. While the wellbore pressure is effectively managed, under normal conditions, the flow out of returning fluids is substantially equal to the flow in of drilling fluids. There is no substantive loss of drilling fluids into the formation and there is no substantive influx of formation fluids into the wellbore.

However, there are situations where drilling operations encounter fractured rock or formations prone to severe or total loss of drilling fluids downhole. These naturally fractured reservoirs may contain fractures ranging in size from small fissures to large caverns. When drilling reaches a fractured reservoir, the pore pressure and fracture pressure are virtually the same, effectively nullifying the ability of managed pressure drilling techniques to maintain well control. Maintaining fluid levels within the wellbore is difficult due to severe or total loss of drilling fluids to the formation. When a total loss situation occurs, the fluid level in the annulus may fall below the surface and drilling might be conducted without any fluid returns to the surface. When drilling under these conditions, if the well crosses a formation with a pore pressure higher than the current annular pressure, an influx of unknown formation fluids, often containing explosive or poisonous gas, may enter the wellbore. While this is an unsustainable situation from an economic and resource perspective due to the total loss of the drilling fluids, there is substantial danger because the gas tends to rise in the annulus and, if it reaches the surface, can result in loss of life, catastrophic damage to the rig, and environmental fouling. Pressurized mud cap drilling is a related drilling technique used to drill in fractured carbonates or any other fractured rock or formation prone to total loss of drilling fluids downhole with good wellbore stability characteristics.

BRIEF SUMMARY OF THE INVENTION

According to one aspect of one or more embodiments of the present invention, a method of safe pressurized mud cap drilling includes determining a set point for a surface backpressure choke manifold, injecting sacrificial fluids into a drillstring disposed in a wellbore, injecting weighted mud into an annulus surrounding the drillstring, and monitoring a surface backpressure. If the surface backpressure rises above the set point, closing one or more chokes of the surface backpressure choke manifold in a stepwise incremental manner to increase an injection rate of weighted mud into the annulus. If the surface backpressure falls below the set point, opening the one or more chokes of the surface backpressure choke manifold in a stepwise incremental manner to decrease the injection rate of weighted mud into the annulus. If the surface backpressure is substantially equal to the set point, maintaining a state of the one or more chokes of the surface backpressure choke manifold to maintain the injection rate of weighted muds into the annulus.

According to one aspect of one or more embodiments of the present invention, a drilling system for safe pressurized mud cap drilling includes a first fluid line configured to inject sacrificial fluids into a drillstring disposed in a wellbore, a second fluid line configured to inject weighted mud into an annulus surrounding the drillstring, a surface backpressure choke manifold that includes one or more chokes fluidly connected to the annulus, and a control system configured to automatically control a state of the one or more chokes of the surface backpressure choke manifold to maintain a predetermined surface backpressure set point.

According to one aspect of one or more embodiments of the present invention, a method of safe pressurized mud cap drilling includes determining a lower limit and an upper limit for a surface backpressure choke manifold, injecting sacrificial fluids into a drillstring disposed in a wellbore, injecting weighted mud into an annulus surrounding the drillstring, and monitoring a surface backpressure. If the surface backpressure rises above the upper limit, closing one or more chokes of the surface backpressure choke manifold in a stepwise incremental manner to increase an injection rate of weighted mud into the annulus. If the surface backpressure falls below the lower limit, opening the one or more chokes of the surface backpressure choke manifold in a stepwise incremental manner to decrease the injection rate of weighted mud into the annulus. If the surface backpressure is within the lower limit and the upper limit, maintaining a state of the one or more chokes of the surface backpressure choke manifold to maintain the injection rate of weighted muds into the annulus.

According to one aspect of one or more embodiments of the present invention, a drilling system for safe pressurized mud cap drilling includes a first fluid line configured to inject sacrificial fluids into a drillstring disposed in a wellbore, a second fluid line configured to inject weighted mud into an annulus surrounding the drillstring, a surface backpressure choke manifold that includes one or more chokes fluidly connected to the annulus, and a control system configured to automatically control a state of the one or more chokes of the surface backpressure choke manifold to maintain surface backpressure within a lower limit and an upper limit.

According to one aspect of one or more embodiments of the present invention, a method of safe pressurized mud cap drilling includes determining a set point, a lower limit, and an upper limit for a surface backpressure choke manifold, injecting sacrificial fluids into a drillstring disposed in a wellbore, injecting weighted mud into an annulus surrounding the drillstring, and monitoring a surface backpressure. If the surface backpressure rises above the upper limit, closing one or more chokes of the surface backpressure choke manifold in a stepwise incremental manner until the surface backpressure falls to the set point to increase an injection rate of weighted mud into the annulus. If the surface backpressure falls below the lower limit, opening the one or more chokes of the surface backpressure choke manifold in a stepwise incremental manner until the surface backpressure rises to the set point to decrease the injection rate of weighted mud into the annulus. If the surface backpressure is substantially equal to the set point, maintaining a state of the one or more chokes of the surface backpressure choke manifold to maintain the injection rate of weighted muds into the annulus.

According to one aspect of one or more embodiments of the present invention, a drilling system for safe pressurized mud cap drilling includes a first fluid line configured to inject sacrificial fluids into a drillstring disposed in a wellbore, a second fluid line configured to inject weighted mud into an annulus surrounding the drillstring, a surface backpressure choke manifold that includes one or more chokes fluidly connected to the annulus, and a control system configured to automatically control a state of the one or more chokes of the surface backpressure choke manifold to maintain surface backpressure at a set point within a lower limit and an upper limit.

Other aspects of the present invention will be apparent from the following description and claims.

DETAILED DESCRIPTION OF THE INVENTION

Figure 1:
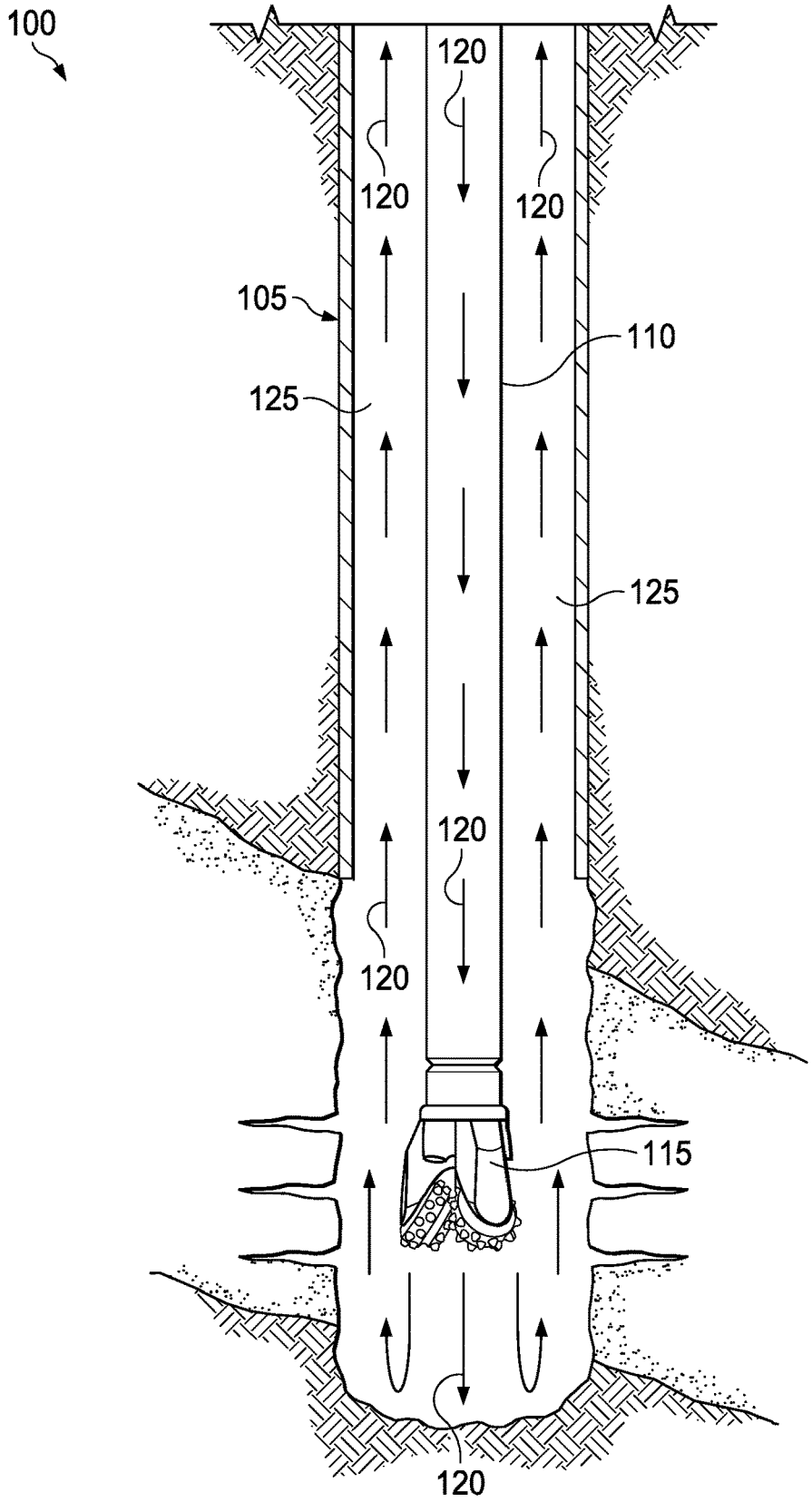
FIG. 1 (PRIOR ART)
FIG. 1 shows the flow of drilling fluids during conventional managed pressure drilling operations.

One or more embodiments of the present invention are described in detail with reference to the accompanying figures. For consistency, like elements in the various figures are denoted by like reference numerals. In the following detailed description of the present invention, specific details are set forth in order to provide a thorough understanding of the present invention. In other instances, well-known features to one of ordinary skill in the art are not described to avoid obscuring the description of the present invention.

FIG. 1 shows the flow of drilling fluids during conventional managed pressure drilling operations 100. A drilling rig (not shown) is typically used to drill a wellbore 105 to recover oil or gas reserves (not shown) disposed below the Earth's surface (not shown). The drilling rig (not shown) may be a land-based drilling rig (not shown) or a fixed or floating drilling rig (not shown) disposed on a body of water. A drillstring 110 is inserted into a wellbore 105. A drill bit 115 is disposed on a distal end of drillstring 110. During conventional managed pressure drilling operations, drilling fluids 120 are pumped through an interior passage of drillstring 110 and through drill bit 115 to cool and lubricate drill bit 115 while it drills, flush cuttings (not shown) from the bottom of the hole, and counterbalance the formation pressure. Drilling fluids 120 from the bottom of the hole are returned to the surface (not shown) via an annulus 125 surrounding drillstring 110. Under typical managed pressure drilling conditions, the wellbore pressure (not shown) is managed within a gradient (not shown) bounded by the pore pressure (not shown) and the fracture pressure (not shown) of the formation. So long as the wellbore pressure is within the gradient, drilling fluids are not lost to the formation and there is no unintentional influx of unknown formation fluids into the wellbore.

Figure 2:
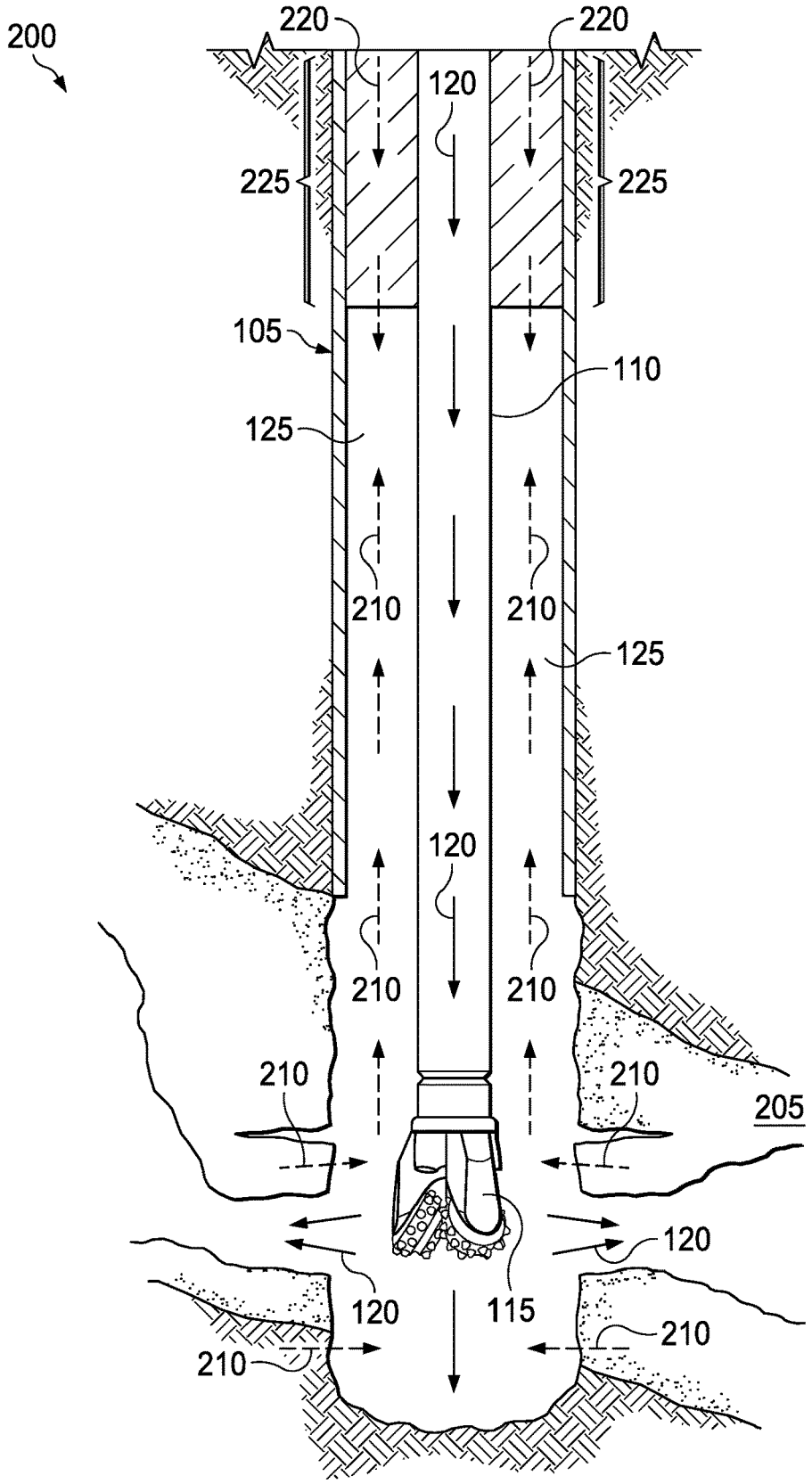
FIG. 2 (PRIOR ART)
FIG. 2 shows the flow of drilling fluids and formation fluids during conventional pressurized mud cap drilling operations.

FIG. 2 shows the flow of drilling fluids and formation fluids during conventional pressurized mud cap drilling operations 200. Upon encountering a fractured reservoir, the driller (not shown) may recognize a total loss of injected drilling fluids 120 into the formation 205. When a total loss situation occurs, the fluid level in the annulus 125 may fall below the surface and drilling might be conducted without any fluid returns to the surface. When drilling under these conditions, if the well crosses a formation with a pore pressure higher than the current annular pressure, an influx of unknown formation fluids 210, often containing explosive or poisonous gas, may enter the wellbore 105. These formation fluids 210, specifically the gases, tend to rise in annulus 125, presenting a very serious safety and environmental risk if they make it to the surface. As such, the driller (not shown) must recognize that they have encountered a fractured carbonate or similar type of reservoir and take steps to transition to a pressurized mud cap drilling technique while drilling through the fractured rock.

In pressurized mud cap drilling, in a manner similar to conventional managed pressure drilling operations, the top of the wellbore 105 is closed with an annular closing (not shown), typically a rotating control device (not shown), that seals the annulus 125 between the drillstring 110 and the casing 215. The fluid return (not shown) from the annular closing (not shown) is diverted to a surface backpressure choke manifold (not shown), which is closed to prevent fluid flow. The pressure upstream of the surface backpressure choke manifold (not shown) is monitored and when it rises above a user-defined set point, weighted mud 220 is injected into the annulus 125 until the pressure reduces to the set point, forming a mud cap 225. The weighted mud 220 may be a drilling fluid or any other mud that contains one or more weighting agents. While the weighted mud 220 is injected at the top of the annulus 125, the formation fluids, or gas, 210 rise up through the annulus 125 from the bottom. Over time, the mud cap 225 will tend to lower and lose height with respect to the wellbore 105. When this happens, the annular pressure at the surface increases, requiring additional weighted mud 220 to be injected into the annulus 125 to restore the mud cap 225 and reduce the annular pressure to user-defined limits. The drilling operations may continue by intermittently turning the pumps on and off as needed to inject the weighted mud 220 into the annulus 125 in order to keep the pressure at the surface backpressure choke manifold (not shown) within the user-defined limits. Drilling is conducted by injecting a sacrificial fluid, such as seawater, 120 into the drillstring 110. While the use of the mud cap 225 is effective at preventing dangerous gas 210 from reaching the surface, the nature of the liquid mud cap 225 is to fall within the wellbore while the nature of the dangerous gases 210 is to rise through the annulus. As such, the conventional pressurized mud cap drilling technique requires the intermittent injection of weighted mud 220 to prevent gas 210 from reaching the surface.

Figure 3:
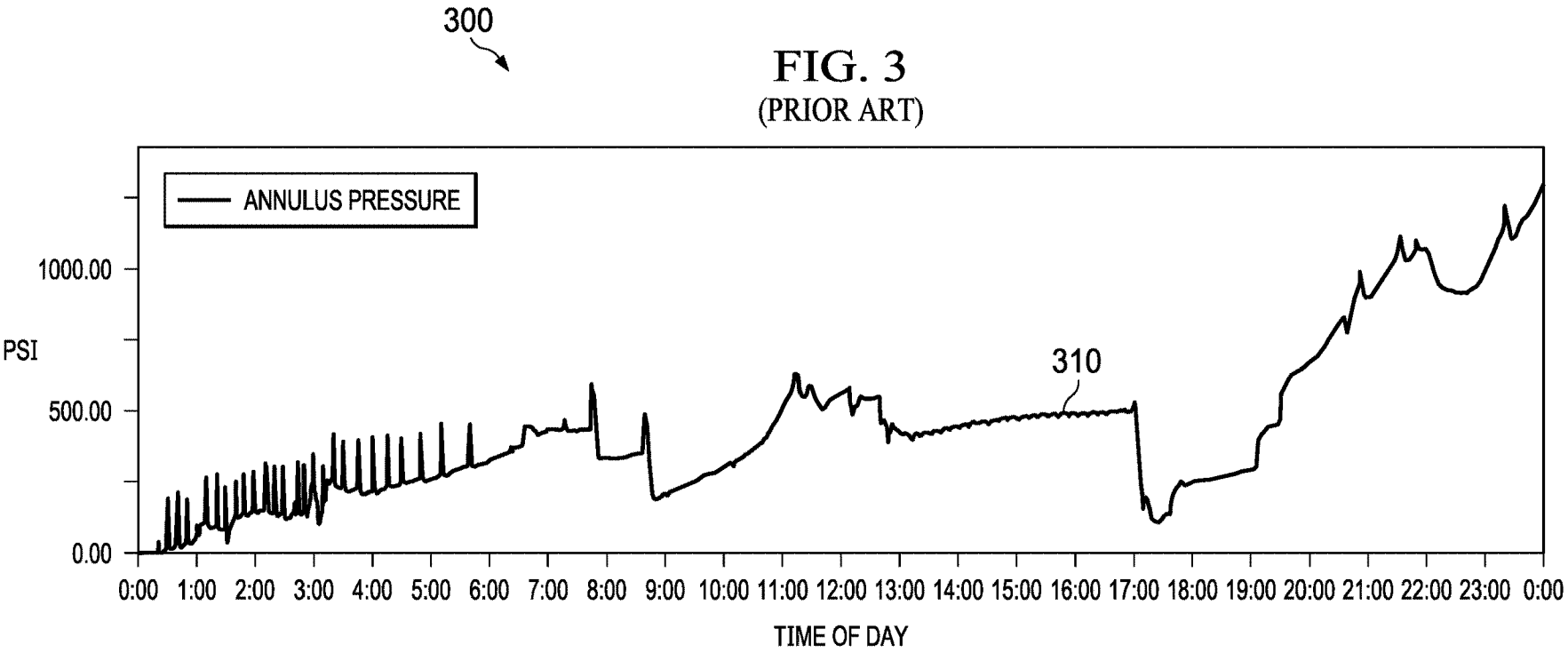
FIG. 3 (PRIOR ART)
FIG. 3 shows an annular pressure plot for a conventional pressurized mud cap drilling operation.

FIG. 3 shows an annular pressure plot for a conventional pressurized mud cap drilling operation 300. The starting and stopping of the pumps (not shown) to inject weighted mud (e.g., 220 of FIG. 2) into the annulus (e.g., 125 of FIG. 2) based on the pressure in the annulus requires a significant amount of manual intervention as well as continuous monitoring of the annular pressure to ensure that the injection operation is conducted within the established limits. In the figure, the annular pressure 310 is plotted as a function of time for a twenty-four hour period. The abrupt spikes in the annular pressure 310 correspond to times when injection was performed in response to an increase in annulus pressure 310.

Conventionally, pressurized mud cap drilling was performed manually, as discussed above, where the driller, or other person assigned to monitor pressure, monitored the annular pressure 310, if the pressure exceeded a user-defined set point, the driller (not shown) would inject weighted mud (e.g., 220 of FIG. 2) into the annulus (e.g., 125 of FIG. 2) until the pressure fell to the set point. The driller (not shown) would intermittently turn the pumps on and off as needed to keep the annular pressure within the user-defined limits. This conventional approach to pressurized mud cap drilling presents a number of issues, requiring the manual determination that pressurized mud cap drilling is necessary, monitoring the annular pressure, and manually starting and stopping the pumps to inject weighted mud into the annulus when the annular pressure exceeded a user-defined set point. A micro-flux control method has been used in an attempt to automate pressurized mud cap drilling, however, they use net loss into the well as the control parameter and still require significant manual intervention to monitor the pressure from the surface and adjust the net loss if the pressure increases or decreases.

Accordingly, in one or more embodiments of the present invention, a method and system for safe pressurized mud cap drilling provides an improved and simplified way of maintaining a mud cap that is fully automatable and does not require manual intervention of any kind. In contrast to conventional approaches, the pumps are not intermittently started and stopped, but are instead turned on and left on with a constant flow rate, however, the effective injection rate of weighted mud into the annulus is controlled by manipulation of the annular pressure in a counterintuitive manner. Advantageously, the mud cap is maintained in a safe manner that allows for continuous drilling without manual intervention.

Figure 4:
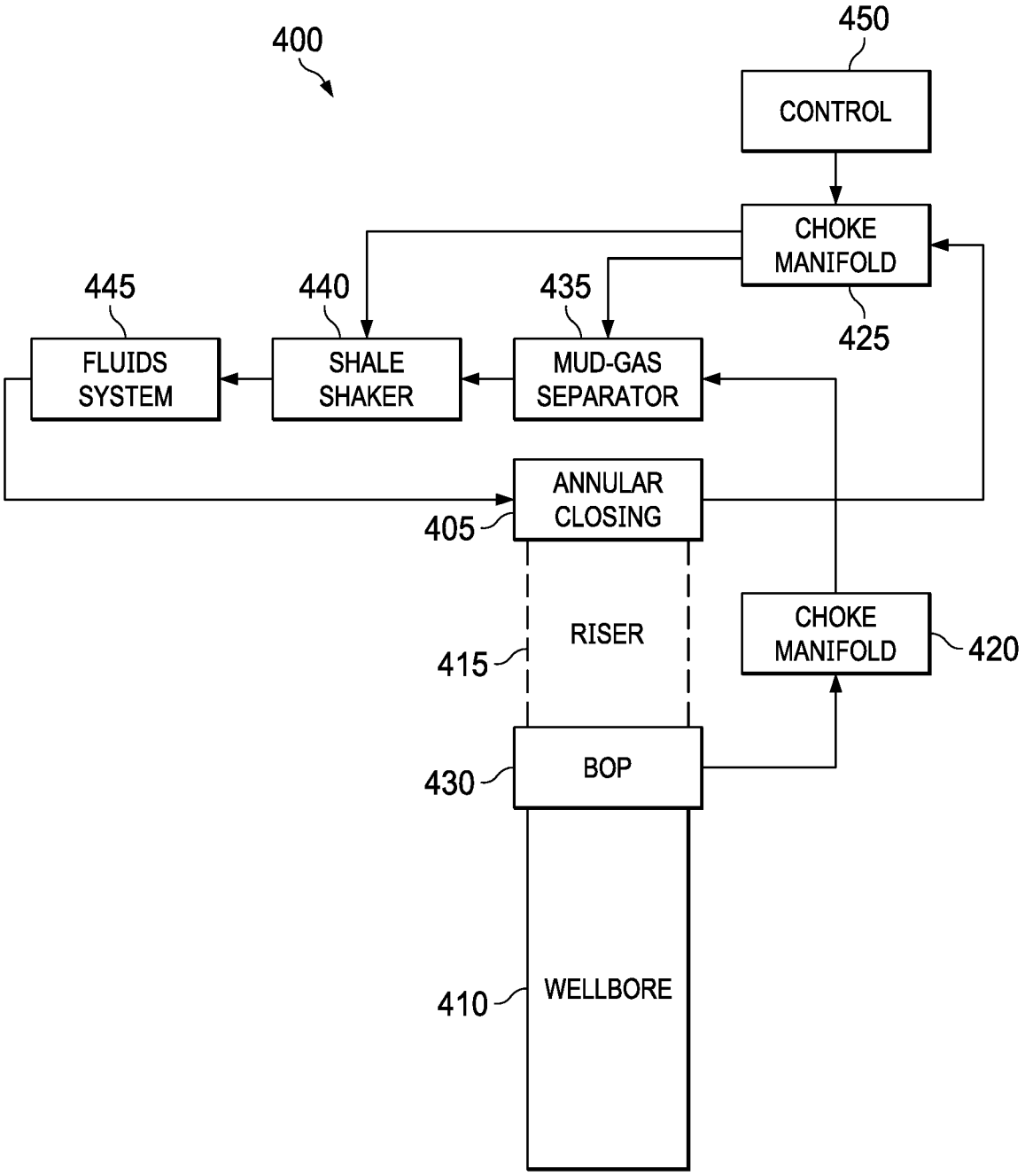
FIG. 4 shows a block diagram of a drilling system for safe pressurized mud cap drilling in accordance with one or more embodiments of the present invention.

FIG. 4 shows a block diagram of a drilling system for safe pressurized mud cap drilling 400 in accordance with one or more embodiments of the present invention. Drilling system 400 may be a managed pressure drilling system that allows for the closed-loop circulation of fluids and the management of wellbore pressure from the surface.

Drilling system 400 includes an annular closing 405 that controllably seals the annulus between the drillstring (not shown) and the wellbore 410 (land-based rig embodiments) or marine riser 415 (floating rig embodiments). Annular closing 405 may be a rotating control device, a non-rotating control device, a drillstring isolation tool, or any other active pressure management device that controllably seals the annulus. Drilling system 400 includes a first choke manifold 420, typically a well-control choke manifold for maintaining well control, and a second choke manifold 425, often, a dedicated surface backpressure choke manifold for managing surface backpressure. One of ordinary skill in the art will recognize that well control choke manifold 420 and surface backpressure choke manifold 425 generally serve the same purpose, but may not be the same type or kind of choke manifold and may vary based on an application or design in accordance with one or more embodiments of the present invention. Fluids may be returned from BOP 430 to the surface for processing via a wellbore fluid return line that directs fluid flow to well control choke manifold 420. Fluids may also be returned from annular closing 405 to the surface for processing via a managed pressure drilling fluid return line that directs fluid flow to surface backpressure choke manifold 425. If the returning fluids are believed to contain gas, the fluid output of choke manifolds 420 and 425 may be directed to a mud-gas separator 435 to separate the mud from the gas. Once the gas has been removed, the degassed fluids may be sent via a fluid line to shale shaker 440 to remove cuttings and solids and prepare the fluids for reuse. If the returning fluids contain little to no gas, the fluid output of choke manifold 425 may be directed directly to shale shaker 440. The degassed and cleaned drilling fluids may then be recycled by a fluids system 445 for further use downhole.

In one or more embodiments of the present invention, a control system 450 may perform, in whole or in part, the method of safe pressurized mud cap drilling. Control system 450 may receive, as input, information relating to, for example, one or more of flow in, flow out, surface backpressure, a user-defined preference for a set point, lower limit, and upper limit of surface backpressure in pressurized mud cap drilling mode, and type, kind, size, capacity, rating, and topology of various equipment on the rig. Control system 450 may be able to calculate or otherwise determine certain data values based on the input received. For example, absent user-defined preferences for one or more of a set point, lower limit, and upper limit of surface backpressure, control system 450 may determine one or more of a set point, lower limit, and upper limit of surface backpressure based on a type, kind, size, capacity, and rating of the surface backpressure choke manifold and other input. One of ordinary skill in the art will recognize that the set point, lower limit, and upper limit may be determined solely based on the surface backpressure choke manifold used where lower and upper limits may be dictated by rating and capacity and the set point may be dictated by a desired optimal operating point. Similarly, one of ordinary skill in the art will recognize that other input may be used to determine, or refine, the set point, lower limit, and/or upper limit used.

During drilling operations, control system 450 may determine in real time when a pressurized mud cap drilling condition is met based on measured flow rates in and out of the wellbore. When there is a total loss of drilling fluids into the formation, meaning all fluids injected are lost into the formation and there are no fluid returns to the surface, the pressurized mud cap drilling condition is met. Control system 450 may then prompt a user to confirm that they wish to enter into safe pressurized mud cap drilling mode or may automatically make the transition from managed pressure drilling. Control system 450 may then use the user-defined preferences for, or determine based on various input, one or more of a set point, a lower limit, and an upper limit of surface backpressure for the surface backpressure choke manifold 425. The determination may be made based on user-defined preferences and various input, including a type, kind, size, capacity, and rating of the surface backpressure choke manifold 425, other equipment on the surface, and/or historical data. Control system 450 may then automatically start, or advise the user to manually start, the pumps injecting sacrificial fluids into the drillstring and weighted mud into the annulus surrounding the drillstring. Control system 450 may continuously monitor surface backpressure, the data provided by a sensor disposed upstream of the surface backpressure choke manifold 425.

In certain embodiments that use only a surface backpressure set point, if the surface backpressure rises above the surface backpressure set point, control system 450 may start closing one or more chokes of the surface backpressure choke manifold 425 in a stepwise incremental manner until the surface backpressure falls to the set point to increase the injection rate of weighted mud into the annulus. If the surface backpressure falls below the surface backpressure set point, control system 450 may start opening one or more chokes of the surface backpressure choke manifold 425 in a stepwise incremental manner until the surface backpressure rises to the surface backpressure set point to decrease the injection rate of weighted muds into the annulus. And if the surface backpressure is substantially equal to the surface backpressure set point (or optionally within a certain window around it), control system 450 may maintain a state of the one or more chokes of the surface backpressure choke manifold 425 to maintain the injection rate of weighted mud into the annulus.

In other embodiments that use an upper limit and lower limit of surface backpressure, if the surface backpressure rises above an upper limit of surface backpressure, control system 450 may start closing one or more chokes of the surface backpressure choke manifold 425 in a stepwise incremental manner until the surface backpressure falls below the upper limit of surface backpressure to increase the injection rate of weighted mud into the annulus. If the surface backpressure falls below a lower limit of surface backpressure, control system 450 may start opening one or more chokes of the surface backpressure choke manifold 425 in a stepwise incremental manner until the surface backpressure rises above the lower limit of surface backpressure to decrease the injection rate of weighted muds into the annulus. And if the surface backpressure is within the lower and upper limits of surface backpressure, control system 450 may maintain a state of the one or more chokes of the surface backpressure choke manifold 425 to maintain the injection rate of weighted mud into the annulus.

In still other embodiments that use a set point, lower limit, and upper limit of surface backpressure, if the surface backpressure rises above an upper limit of surface backpressure, control system 450 may start closing one or more chokes of the surface backpressure choke manifold 425 in a stepwise incremental manner until the surface backpressure falls to the surface backpressure set point to increase the injection rate of weighted mud into the annulus. If the surface backpressure falls below a lower limit of surface backpressure, control system 450 may start opening one or more chokes of the surface backpressure choke manifold 425 in a stepwise incremental manner until the surface backpressure rises to the surface backpressure set point to decrease the injection rate of weighted muds into the annulus. And if the surface backpressure is substantially equal to the surface backpressure set point, control system 450 may maintain a state of the one or more chokes of the surface backpressure choke manifold 425 to maintain the injection rate of weighted mud into the annulus.

Advantageously, in all embodiments, the flow rates of the sacrificial fluids injected downhole and weighted mud injected into the annulus remain constant (the pumps are simply turned on and kept at the same speed, except for a connection when the sacrificial fluid pump is turned off for a short period of time), but the effective injection rate of weighted mud into the annulus is modulated by the sole control of surface backpressure in a counterintuitive manner. When the surface backpressure increases, rather than open the choke as would be dictated by managed pressure drilling techniques, the choke is closed somewhat to increase the effective injection rate into the annulus. Similarly, when the surface backpressure decreases, rather than close the choke as would be dictated by managed pressure drilling techniques, the choke is opened somewhat to decrease the effective injection rate into the annulus.

Figure 5:
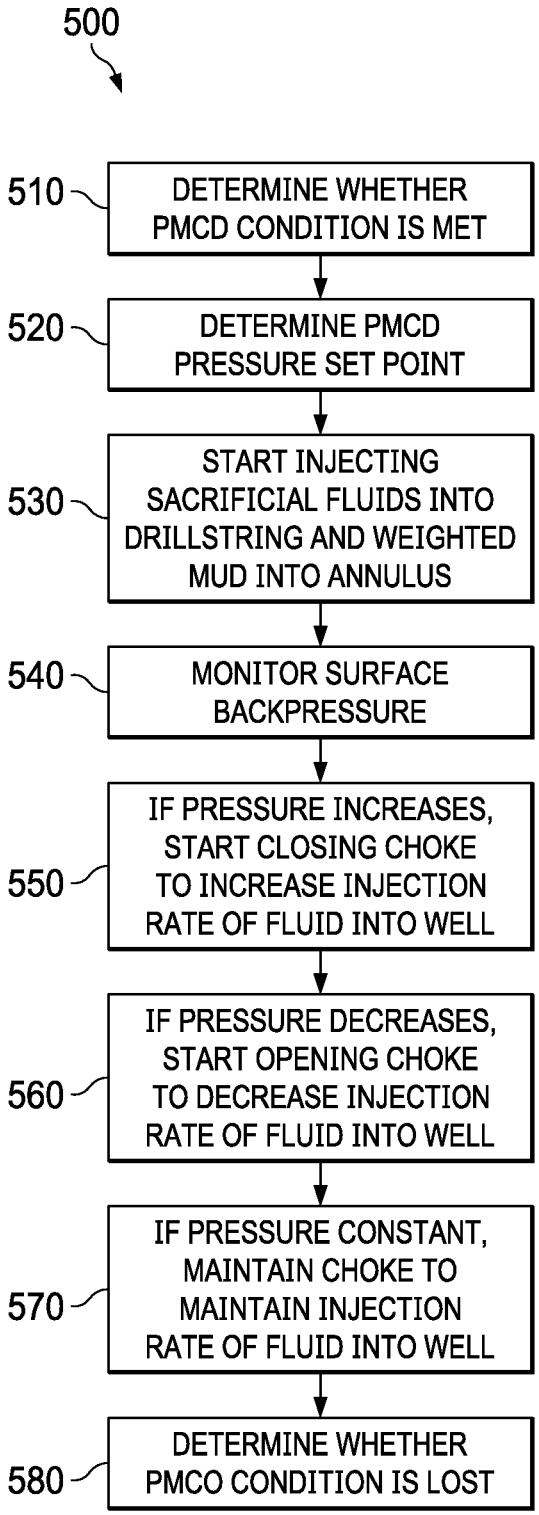
FIG. 5 shows a method of safe pressurized mud cap drilling in accordance with one or more embodiments of the present invention.

FIG. 5 shows a method of safe pressurized mud cap drilling 500 in accordance with one or more embodiments of the present invention. In step 510, a determination may be made as to whether a pressurized mud cap drilling condition is met. In certain embodiments, the pressurized mud cap drilling condition is met when there is a total loss of drilling fluids into the formation and no fluid return to the surface. In step 520, a set point, a lower limit, and/or an upper limit of surface backpressure for the surface backpressure choke manifold may be determined. The determination may be made based on one or more of user-defined preferences for such values, user-provided input, well conditions, a type, kind, size, capacity, or pressure rating of an annular closing device, a type, kind, size, capacity, or pressure rating of a surface backpressure choke manifold, other equipment on the surface, and/or historical data. In step 530, sacrificial fluids may be injected into the drillstring and weighted mud may be injected into the annulus surrounding the drillstring. The sacrificial fluids may comprise seawater or any other inexpensive and readily available fluid that does not need to be recovered in the total loss situation. The weighted mud may comprise a fluid and a weighting agent or any other type or kind of mud suitable for such use. The weighting agent may comprise one or more of barite, hematite, calcium carbonate, siderite, or ilmenite. In certain embodiments, the weighted mud may be non-sacrificial drilling fluids. The pumps are turned on and left on, providing constant flow rates for the injection of the sacrificial fluids and the weighted mud. Advantageously, the method of safe pressurized mud cap drilling controls the effective injection rate into the annulus by manipulation of annular pressure via the choke position of the surface backpressure choke manifold.

In step 540, the surface backpressure may be monitored. The surface backpressure may be measured or sensed by a sensor disposed upstream of the surface backpressure choke manifold. While the surface backpressure is being monitored, the method may make a determination as to what action to take based solely on the single input and control of the surface backpressure. In step 550, if the surface backpressure rises above the surface backpressure set point, start closing one or more chokes of the surface backpressure choke manifold in a stepwise incremental manner to increase an injection rate of weighted mud into the annulus. In other embodiments, an upper limit may be used instead of the set point. In step 560, if the surface backpressure falls below the set point, start opening the one or more chokes of the surface backpressure choke manifold in a stepwise incremental manner to decrease the injection rate of weighted mud into the annulus. In other embodiments, a lower limit may be used instead of the set point. In step 570, if the surface backpressure is substantially equal to the set point, maintaining a state of the one or more chokes of the surface backpressure choke manifold to maintain the injection rate of weighted muds into the wellbore. In other embodiments, the state may be maintained when the surface backpressure is within the lower and upper limits of surface backpressure. In step 580, optionally determine when the pressurized mud cap drilling condition is lost. When the fracture starts healing, the total loss of drilling fluids will transition to partial loss. If the surface backpressure rises and, the system remains in a pressurized mud cap drilling mode, the choke will be closed to inject more weighted mud into the annulus and thereby attempt to reduce the pressure at the surface to the surface backpressure set point. However, if the pressurized mud cap drilling condition has been lost, the closing of the choke will cause the surface backpressure to increase, confirming that the pressurized mud cap drilling condition has been lost.

Figure 6:
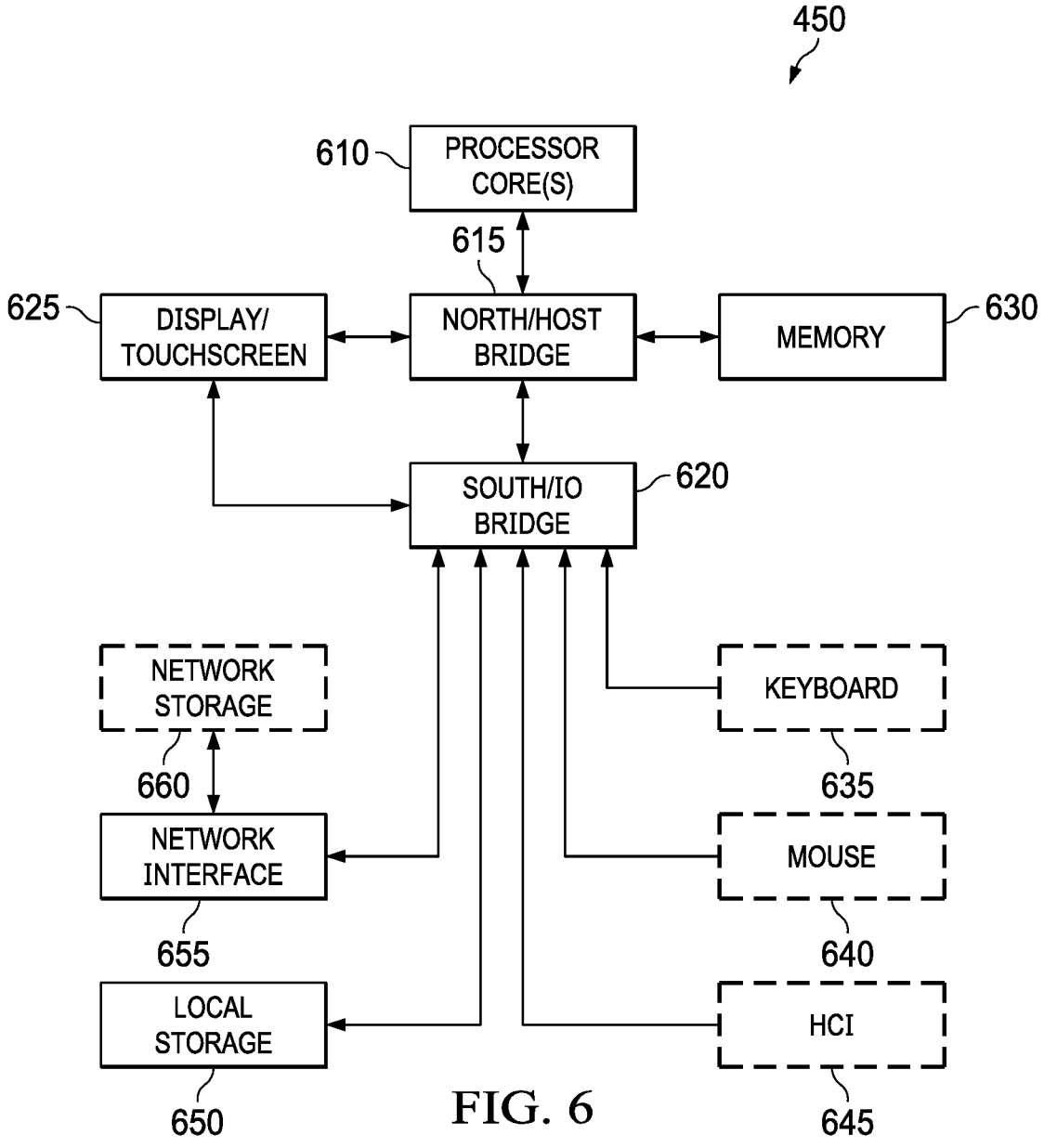
FIG. 6 shows a control system configured to perform a method of safe mud cap drilling in accordance with one or more embodiments of the present invention.

In other embodiments, a method of safe pressurized mud cap drilling (not shown) may be used to automate micro-flux control methods that use net loss into the well as the primary control. In such net loss embodiments, the control system may monitor the surface backpressure and the net loss into the wellbore. The control system may start opening or closing the one or more chokes of the surface backpressure choke manifold to achieve the user-specified net loss, where the net loss is defined as flow out minus flow in. In the event that the net loss specified by the user is not be capable of producing a stable surface backpressure at the surface, it may have to be adjusted by the control system FIG. 6 shows a control system 450 that may be configured to perform, in whole or in part, the method (e.g., 500 of FIG. 5) of safe pressurized mud cap drilling in accordance with one or more embodiments of the present invention. Control system 450 may be used to control a surface backpressure choke manifold (not shown). Control system 450 may output signals (not shown) that are input into the surface backpressure choke manifold (e.g., 425 of FIG. 4) to electronically control the state of one or more of its chokes (not shown).

Control system 450 may include one or more processor cores 610 disposed on one or more printed circuit boards (not shown). Each of the one or more processor cores 610 may be a single-core processor (not independently illustrated) or a multi-core processor (not independently illustrated). Multi-core processors typically include a plurality of processor cores disposed on the same physical die (not shown) or a plurality of processor cores disposed on multiple die (not shown) that are collectively disposed within the same mechanical package. Control system 450 may also include various core logic components such as, for example, a north, or host, bridge device 615 and a south, or input/output ("IO"), bridge device 620. North bridge 615 may include one or more processor interface(s), memory interface(s), graphics interface(s), high speed IO interface(s) (not shown), and south bridge interface(s). South bridge 620 may include one or more IO interface(s). One of ordinary skill in the art will recognize that the one or more processor cores 610, north bridge 615, and south bridge 620, or various subsets or combinations of functions or features thereof, may be integrated, in whole or in part, or distributed among various discrete devices, in a way that may vary based on an application, design, or form factor in accordance with one or more embodiments of the present invention.

Control system 450 may include one or more IO devices such as, for example, a display device 625, system memory 630, optional keyboard 635, optional mouse 640, and/or an optional human-computer interface 645. Depending on the application or design of control system 450, the one or more IO devices may or may not be integrated. Display device 625 may be a touch screen that includes a touch sensor (not independently illustrated) configured to sense touch. For example, a user may interact directly with objects depicted on display device 625 by touch or gestures that are sensed by the touch sensor and treated as input by control system 450.

Control system 450 may include one or more local storage devices 650. Local storage device 650 may be a solid-state memory device, a solid-state memory device array, a hard disk drive, a hard disk drive array, or any other non-transitory computer readable medium. Control system 450 may include one or more network interface devices 655 that provide one or more network interfaces. The network interface may be Ethernet, Wi-Fi, Bluetooth, WiMAX, Fibre Channel, or any other network interface suitable to facilitate networked communications.

Control system 450 may include one or more network-attached storage devices 660 in addition to, or instead of, one or more local storage devices 650. Network-attached storage device 660 may be a solid-state memory device, a solid-state memory device array, a hard disk drive, a hard disk drive array, or any other non-transitory computer readable medium. Network-attached storage device 660 may or may not be collocated with control system 450 and may be accessible to control system 450 via one or more network interfaces provided by one or more network interface devices 655.

One of ordinary skill in the art will recognize that control system 450 may be a cloud-based server, a server, a workstation, a desktop, a laptop, a netbook, a tablet, a smartphone, a mobile device, and/or any other type of computing system in accordance with one or more embodiments of the present invention. Moreover, one of ordinary skill in the art will recognize that control system 450 may be any other type or kind of system based on programmable logic controllers ("PLC"), programmable logic devices ("PLD"), or any other type or kind of system, including combinations thereof, capable of inputting data, performing calculations, and outputting control signals that manipulate a smart choke manifold.

Advantages of one or more embodiments of the present invention may include one or more of the following:

In one or more embodiments of the present invention, a method and system for safe pressurized mud cap drilling provides an improved and simplified mechanism for maintaining an effective mud cap in pressurized mud cap drilling operations that is capable of being fully automated.

In one or more embodiments of the present invention, a method and system for safe pressurized mud cap drilling uses annular pressure alone as the control.

In one or more embodiments of the present invention, a method and system for safe pressurized mud cap drilling manipulates surface backpressure to control the effective injection rate of weighted muds into the annulus surrounding the drillstring.

In one or more embodiments of the present invention, a method and system for safe pressurized mud cap drilling reduces or eliminates the need for manual intervention.

In one or more embodiments of the present invention, a method and system for safe pressurized mud cap drilling reduces or eliminates spikes in annular pressure and the corresponding risk the spikes represent due to rising gas in the annulus.

In one or more embodiments of the present invention, a method and system for safe pressurized mud cap drilling improves the safety of pressurized mud cap drilling operations for the personnel, the rig, and the environment.

While the present invention has been described with respect to the above-noted embodiments, those skilled in the art, having the benefit of this disclosure, will recognize that other embodiments may be devised that are within the scope of the invention as disclosed herein. Accordingly, the scope of the invention should be limited only by the appended claims.

What is claimed is:

1. A method of safe pressurized mud cap drilling comprising:

determining a set point for a surface backpressure choke manifold;

injecting sacrificial fluids into a drillstring disposed in a wellbore;

injecting weighted mud into an annulus surrounding the drillstring, wherein the annulus is sealed and wherein one or more pumps for injecting weighted mud are turned on and left on at a substantially constant flow rate during safe pressurized mud cap drilling; and controlling an effective injection rate of weighted mud into the annulus by:

monitoring a surface backpressure, if the surface backpressure rises above the set point, closing one or more chokes of the surface backpressure choke manifold to increase the effective injection rate of weighted mud into the annulus, if the surface backpressure falls below the set point, opening the one or more chokes of the surface backpressure choke manifold to decrease the effective injection rate of weighted mud into the annulus, and if the surface backpressure is substantially equal to the set point, maintaining a state of the one or more chokes of the surface backpressure choke manifold to maintain the effective injection rate of weighted muds into the annulus.

2. The method of claim 1, wherein the set point is determined based on one or more of user input, well conditions, a pressure rating of an annular closing device, and a pressure rating of the surface backpressure choke manifold.

3. The method of claim 1, wherein the sacrificial fluids comprise seawater.

4. The method of claim 1, wherein the weighted mud comprises a fluid and a weighting agent.

5. A method of safe pressurized mud cap drilling comprising:

determining a lower limit and an upper limit for a surface backpressure choke manifold;

injecting sacrificial fluids into a drillstring disposed in a wellbore;

injecting weighted mud into an annulus surrounding the drillstring, wherein the annulus is sealed and wherein one or more pumps for injecting weighted mud are turned on and left on at a substantially constant flow rate during safe pressurized mud cap drilling; and controlling an effective injection rate of weighted mud into the annulus by:

monitoring a surface backpressure, if the surface backpressure rises above the upper limit, closing one or more chokes of the surface backpressure choke manifold to increase the effective injection rate of weighted mud into the annulus, if the surface backpressure falls below the lower limit, opening the one or more chokes of the surface backpressure choke manifold to decrease the effective injection rate of weighted mud into the annulus, and if the surface backpressure is within the lower limit and the upper limit, maintaining a state of the one or more chokes of the surface backpressure choke manifold to maintain the effective injection rate of weighted muds into the annulus.

6. The method of claim 5, wherein the lower limit and upper limit are determined based on one or more of user input, well conditions, a pressure rating of an annular closing device, and a pressure rating of a surface backpressure choke manifold.

7. The method of claim 5, wherein the sacrificial fluids comprise seawater.

8. The method of claim 5, wherein the weighted mud comprises a fluid and a weighting agent.

9. A method of safe pressurized mud cap drilling comprising:

determining a set point, a lower limit, and an upper limit for a surface backpressure choke manifold;

injecting sacrificial fluids into a drillstring disposed in a wellbore;

injecting weighted mud into an annulus surrounding the drillstring, wherein the annulus is sealed and wherein one or more pumps for injecting weighted mud are turned on and left on at a substantially constant flow rate during safe pressurized mud cap drilling; and controlling an effective injection rate of weighted mud into the annulus by:

monitoring a surface backpressure, if the surface backpressure rises above the upper limit, closing one or more chokes of the surface backpressure choke manifold until the surface backpressure falls to the set point to increase the effective injection rate of weighted mud into the annulus;

if the surface backpressure falls below the lower limit, opening the one or more chokes of the surface backpressure choke manifold until the surface backpressure rises to the set point to decrease the effective injection rate of weighted mud into the annulus, and if the surface backpressure is substantially equal to the set point, maintaining a state of the one or more chokes of the surface backpressure choke manifold to maintain the effective injection rate of weighted muds into the annulus.

10. The method of claim 9, wherein the set point, lower limit, and upper limit are determined based on one or more of user input, well conditions, a pressure rating of an annular closing device, and a pressure rating of the surface backpressure choke manifold.

11. The method of claim 9, wherein the sacrificial fluids comprise seawater.

12. The method of claim 9, wherein the weighted mud comprises a fluid and a weighting agent.

* * * * *